United States Patent [19]

Ashmead et al.

[11] 4,036,036

[45] July 19, 1977

[54] LATCH NEEDLE FOR KNITTING MACHINES

[75] Inventors: Albert Sidney Ashmead, Torrington; William Alden Ross, New Hartford; Richard Wilton Shepard, Torrington, all of Conn.

[73] Assignee: The Torrington Company, Torrington, Conn.

[21] Appl. No.: 669,401

[22] Filed: Mar. 22, 1976

[51] Int. Cl.[2] ..... D04B 35/02; D04B 35/04

[52] U.S. Cl. ..... 66/123

[58] Field of Search ..... 66/121, 123, 124; 112/223, 222; 163/2, 3

[56] References Cited

U.S. PATENT DOCUMENTS

| | | | |
|---|---|---|---|
| 664,808 | 12/1900 | Dodge | 66/123 |
| 2,603,958 | 7/1952 | St. Pierre | 66/124 |
| 3,464,237 | 9/1969 | Kohorn | 66/121 |
| 3,699,784 | 10/1972 | Berentzen | 66/123 |
| 3,748,875 | 7/1973 | Slof et al. | 66/123 |

FOREIGN PATENT DOCUMENTS

| | | | |
|---|---|---|---|
| 582,659 | 9/1958 | Italy | 66/124 |

*Primary Examiner*—James Kee Chi

*Attorney, Agent, or Firm*—Frank S. Troidl

[57] ABSTRACT

The body of the needle has at least one lateral opening to relieve stress, absorb shock, and dampen vibrations. The opening or openings are located so as not to extend to the top or bottom of the latch needle body.

5 Claims, 15 Drawing Figures

PRIOR ART

LATCH NEEDLE FOR KNITTING MACHINES

This invention relates to latch needles for use in knitting machines. More particularly, this invention is a new and improved latch needle having means for decreasing hook breakage, latch breakage, needle cheek breakage, as well as other less common defects.

In most knitting machines latch needles are actuated by cams which operate against the butts of the needles and force the needles into reciprocating motions. The cam motion is perpendicular to the needle motion, with the cam's needle-operating surface lying at an angle to the direction of motion of the cam. Since the desire for greater production rates results in the use of ever-greater knitting machine speeds and greater angles on the cams, leading to extremely high rates of acceleration and deceleration of the needles, the cams essentially strike the needle butts at high speed and cause shock, stress, and vibration in the needles. These in turn increase the rate of failure of the needles. The needle failures involved include: hook breakage, latch breakage, cheek breakage, pivot breakage, and less common breaks in other areas of the needle, as well as excessive wear in critical areas such as the hook, the latch pivot, the latch, and the butt itself.

The knitting machines are operated at the fastest possible speed commensurate with the greatest production output per unit cost. That speed is usually limited by the rate of needle failures. Each needle failure results in loss of the needle, defects in the fabric, maintenance expenses, and productive time lost while replacing the needle. There is an optimum machine speed for each particular application. Obviously, there is a significant bonus in the increased output, if the knitting machine operating speed can safely be increased.

There has been much work done to reduce the needle failures due to high speed. For example, cutouts or notches have been made in the top edge and in the bottom edge of the blades in an effort to hopefully dampen the shock delivered to the butts before the shock reaches the hook and latch area. However, needles with notches and cutouts in the bottom surface present rough and irregular surfaces to the bottom of the slot in which the needles operate, causing faster wear in those areas of contact. The cutouts also collect oil and dirt which is an abrasive combination, again adding to the wear. Cutouts in the top edge of the blade of the needle cause similar difficulties between the needle and the cover plate which holds the needle in the slot.

Others have used platic material in and arounnd the butt to reduce the shock to the butt, itself. An example of such use is shown in the U.S. Pat. No. 3,699,784 issued Oct. 24, 1972. The plastic protected butts wear quickly and sometimes the plastic comes off the butt or breaks apart and causes trouble by leaving bits of plastic in harmful areas of the equipment. Also, the butts, if reduced in size to make room for the plastic, may be too weak to give long service life.

We have found that aperatures completely through the needle blade from side to side in the shape of very fine slits and wider slots and holes can effectively reduce the shock and vibration transmitted to the knitting end of the needle and thus markedly increase needle life while at the same time allowing an increase in machine speeds. The slits do not come out at either the top or bottom of the needle blade, although in a few cases they are extended to the rear end of the blade or to the round-out area, two areas which are in contact with nothing but air. Generally speaking, needles of each size and shape must be tuned by using a particular size and shape of opening or openings, to achieve the least harmful vibration and stress for the particular conditions and speeds under which they will operate. However, the same needles will also quite often have longer life at other speeds than this maximum speed than will comparable needles without these beneficial slots and holes for vibration and shock control.

The slits are cut completely through the needle and may be made by a variety of techniques such as laser forming, sheering, milling, lancing, and so forth. The width of the slits vary according to the effect desired; some being as fine as 0.003 inches wide, and others being two or three times the thickness of the needle.

In designing the slits in the needle, we must make a careful balance between the beneficial effects of the reduction of vibration, stress, and shock, and the possible harmful effects of weakening of the needle. We must also be sure that we have not made the needle too light, which might be the case with needles which incorporate large cutouts or notches. While the ordinary engineer might think that the lighter needle with its reduced mass would always be beneficial in such a reciprocating motion mechanism, that is not always the case with knitting needles. Sometimes needles of widely differing weights are flung different distances away from the cam at the end of the cam stroke. The movement away from the cam is known in the industry as "firing" or "overshoot". We have found that different weight needles used in the same machine can cause variable firing and undesirable variations in the finished knit goods. The weight of our needle with very fine slits may not vary significantly from the weight of the needle without slits. We have also found that complete reneedling of a machine with needles of a different weight from the weight of the previous needles, often causes a requirement for readjustment of the machine operating settings and speed.

The invention as well as its many advantages, may be further understood by reference to the following detailed description and drawings in which.

Like parts in the various figures will be referred to by like numbers.

Figure 1:
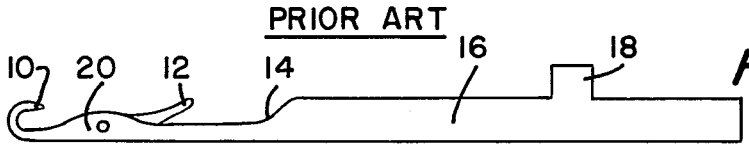
FIG. 1 is a side view of a conventional latch knitting needle.

Referring to the figures, and more particularly to FIG. 1, there is shown a latch needle having a hook 10, a pivotable latch 12, a round out 14, and a body consisting of a blade 16 and a butt 18. In operation, a cam (not shown) in a knitting machine works against the butt 18 to reciprocate the latch needle at high speeds. Defects and other damage often occur to the hook 10, the cheek 20, or the latch 12 due to shock or excessive vibrations transmitted to the portions of the knitting needle. Our invention minimizes the stress, absorbs shock, and dampens the vibrations.

As shown in all the FIGS. 2 through 15, we provide at least one opening which is located in the body so as not to extend to the top of the body which includes the top 22 of blade 16 and the top 24 of butt 18, or to the bottom of the body 26.

Figure 2:
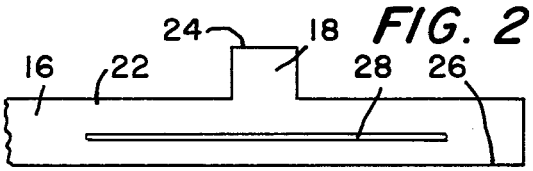
FIGS. 2 through 15 are side views on an enlarged scale of our new latch needles with each of the figures illustrating different preferred modifications.
Figure 3:
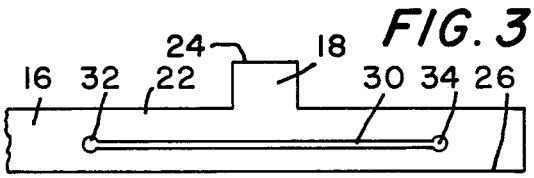
Figure 4:
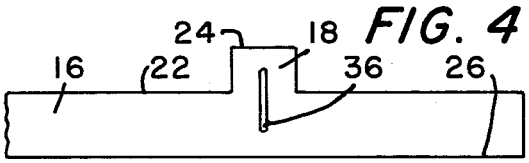

In FIG. 2, slit 28 with rounded ends extends longitudinally along the axis of the blade 16. In FIG. 3 the longitudinally extending slit 30 has keyholes 32 and 34 at its extremities. In FIG. 4, the slit 36 is perpendicular to the axis of the blade 16 and extends from the blade 16 into the butt 18.

Figure 5:
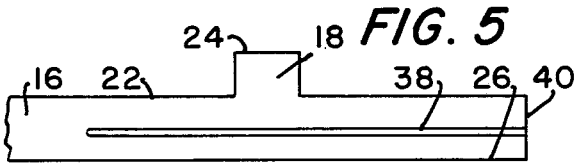
Figure 6:
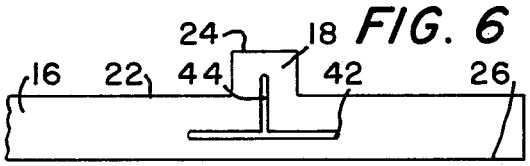

Referring to FIG. 5, the slit 38 is parallel to the top and bottom of the blade and extends to the back end 40 of the blade 16. In FIG. 6, a first slit 42 parallel to the axis of the blade is provided with a second slit 44 perpendicular to the first slit 42 and extending into the butt 18.

Figure 7:
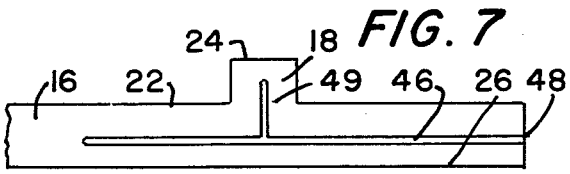
Figure 8:
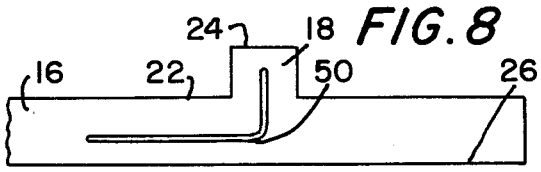
Figure 9:
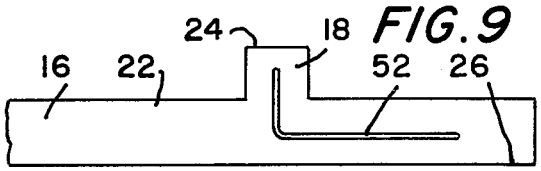

In FIG. 7, the slit 46 parallel to the axis of the blade 16 extends to the back 48 of the blade 16, with a slit 49 perpendicular to slit 46 and extending therefrom into the butt 18. In FIG. 8, the slit 50 extends along the axis of the blade from a point in front of the butt up to the butt, and then curves into the butt 18. In FIG. 9, the slit 52 extends along the axis of the blade from a point behind the butt up to the butt, and then curves into the butt 18.

Figure 10:
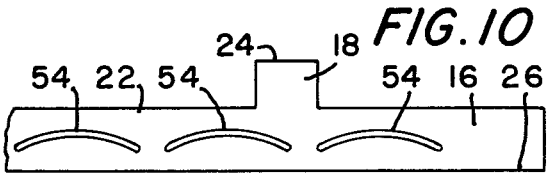
Figure 11:
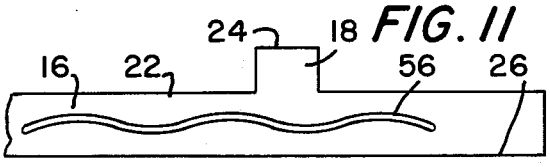
Figure 12:
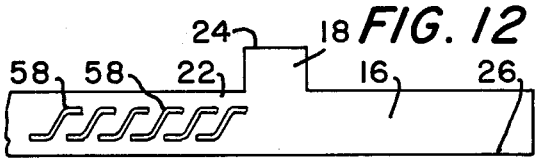
Figure 13:
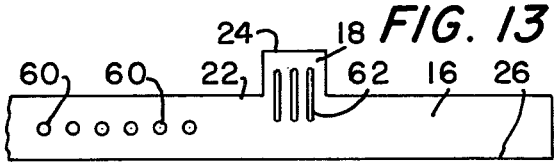

FIG. 10 shows a plurality of curved slits 54 located in spaced apart relation along the axis of the blade 16 and FIG. 11 shows a wavey slit 56 extending along the axis of the blade. FIG. 12 shows a latch needle with a plurality of generally inclined S-shaped slits 58 longitudinally spaced along the axis of the blade 16. The latch needle blade shown in FIG. 13 includes a plurality of circular openings 60 spaced along the axis of the blade and in front of the butt 18 with the butt 18 being provided with a plurality of parallel slits 62.

Figure 14:
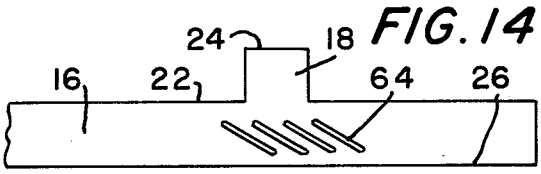

FIG. 14 shows a plurality of inclined slits 64 which are longitudinally spaced along the axis of the blade 16.

Figure 15:
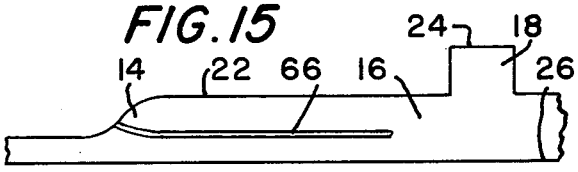

In the embodiment of FIG. 15, the slit 66 extends from a point in the blade in front of the butt 18 parallel to the axis of the blade 16 into the cutout 14.

We claim:

1. In a latch needle having a hook, a pivotable latch, a roundout, and a body consisting of a blade and a butt, the improvement of the body of the needle having at least one lateral opening to relieve stress, absorb shock, and dampen vibrations; said at least one opening extending from the blade into the butt and located so as not to extend to the top or bottom of the body.

2. The latch needle of claim 1 wherein the opening is a slit with rounded ends.

3. The latch needle of claim 2 wherein the slit is perpendicular to the axis of the blade and extends from the blade into the butt.

4. The latch needle of claim 1 wherein the openings are a first slit parallel to the axis of the blade and a second slit perpendicular to the first slit and extending into the butt.

5. A latch needle in accordance with claim 2 wherein the slit extends first along the axis of the blade and then curves into the butt.

* * * * *